US006294304B1

(12) United States Patent
Sukovich et al.

(10) Patent No.: US 6,294,304 B1
(45) **Date of Patent: *Sep. 25, 2001**

(54) ENVIRONMENTALLY BENIGN HIGH CONDUCTIVITY FERRITE CARRIER WITH WIDELY VARIABLE MAGNETIC MOMENT

(75) Inventors: Alan Sukovich; William R. Hutcheson, both of Valparaiso, IN (US)

(73) Assignee: PowderTech Corporation, Valparaiso, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/236,244

(22) Filed: Jan. 25, 1999

Related U.S. Application Data

(60) Provisional application No. 60/072,251, filed on Jan. 23, 1998.

(51) Int. Cl.[7] ..... G03G 9/107

(52) U.S. Cl. ..... 430/111.31; 430/111.33; 430/111.41

(58) Field of Search ..... 430/106.6, 108; 252/62.59

(56) References Cited

U.S. PATENT DOCUMENTS

| | | | | |
|---|---|---|---|---|
| 3,567,641 | * | 3/1971 | Ross et al. | 252/62.59 |
| 3,929,657 | | 12/1975 | Jones . | |
| 4,485,162 | | 11/1984 | Imamura et al. . | |
| 4,623,603 | | 11/1986 | Iimura et al. . | |
| 4,898,801 | | 2/1990 | Tachibana et al. . | |
| 5,199,983 | * | 4/1993 | Katamoto | 430/106.6 |
| 5,419,994 | | 5/1995 | Honjo et al. . | |
| 5,595,850 | | 1/1997 | Honjo et al. . | |
| 5,693,444 | * | 12/1997 | Takagi et al. | 430/106.6 |
| 5,798,198 | * | 8/1998 | Sukovich et al. | 430/106.6 |

OTHER PUBLICATIONS

Diamond, Arthur S. (editor) Handbook of Imaging Materials. New York: Marcel–Dekker, Inc. p. 202, 1991.*

Shambalev, V.N. et al. Self–Dissusion if Cations in the Solid Solution System of Ti–substituted Mn–Zn Ferrites, physica status solidi (a), vol. 11, No. 2, pp.K71–K74, Apr. 1989.*

Fleischer, Michael. Glossary of Mineral Species. Tucson: The Mineralogical Record, Inc. p. 225, 1987.*

Diamond, Arthur S. (editor) Handbook of Imaging Materials. New York: Marcel–Dekker, Inc. pp. 210–215, 222, and 223, 1991.*

* cited by examiner

*Primary Examiner*—Christopher Rodee
(74) *Attorney, Agent, or Firm*—Banner & Witcoff, Ltd.

(57) ABSTRACT

A ferrite carrier includes manganese oxide, ferric oxide and minor amounts of titanium dioxide and provides an environmentally benign, highly conductive, reprographic carrier powder.

9 Claims, 1 Drawing Sheet

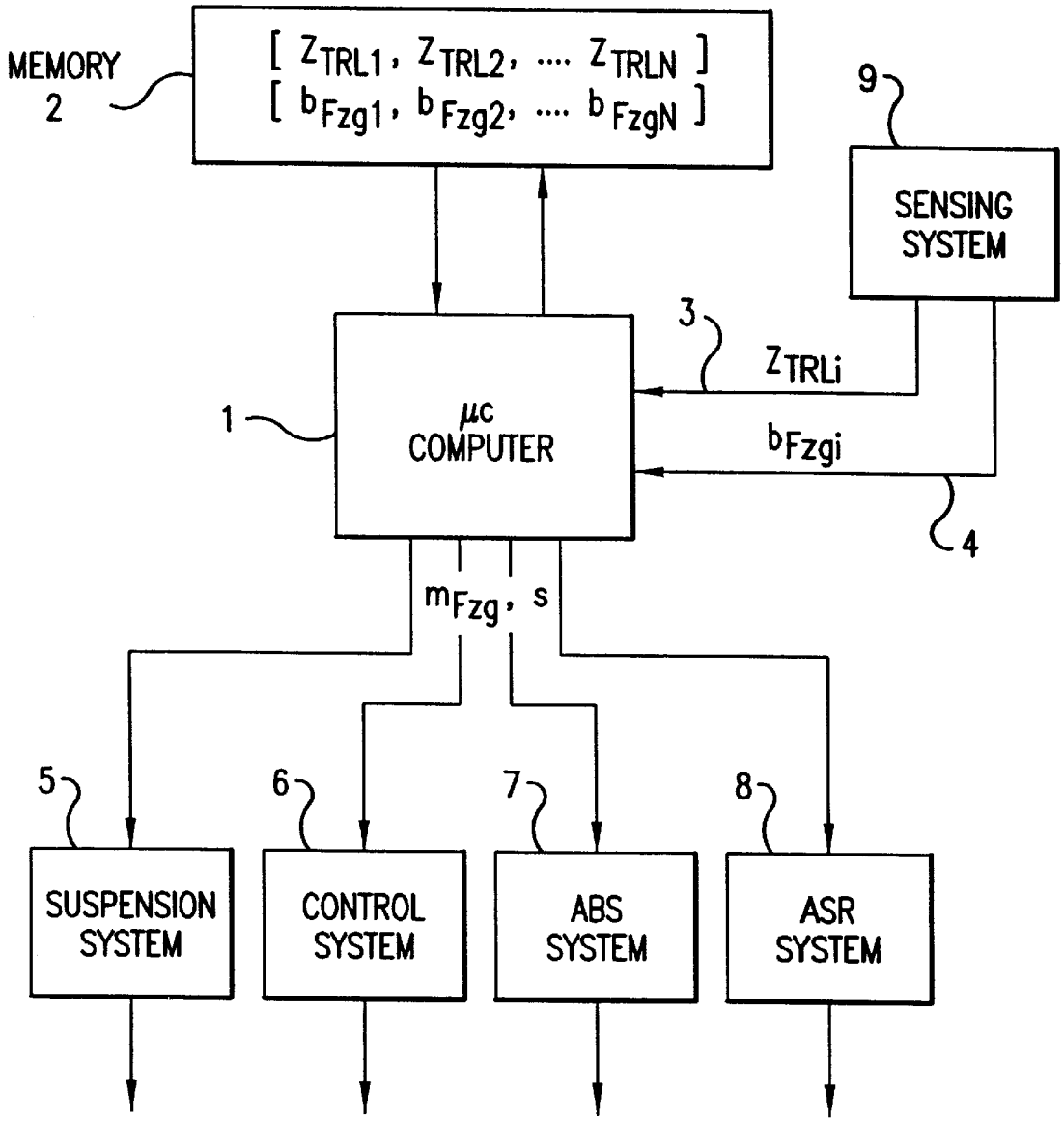
MEMORY
2
[ $Z_{TRL1}$, $Z_{TRL2}$, .... $Z_{TRLN}$ ]
[ $b_{Fzg1}$, $b_{Fzg2}$, .... $b_{FzgN}$ ]
9
SENSING SYSTEM
3
$Z_{TRLi}$
1
μc COMPUTER
$b_{Fzgi}$
4
$m_{Fzg}$, s
5
6
7
8
SUSPENSION SYSTEM
CONTROL SYSTEM
ABS SYSTEM
ASR SYSTEM

ENVIRONMENTALLY BENIGN HIGH CONDUCTIVITY FERRITE CARRIER WITH WIDELY VARIABLE MAGNETIC MOMENT

This application claims benefit of Provisional Application Ser. No. 60/072,251 filed Jan. 23, 1998.

BACKGROUND OF THE INVENTION

The present invention relates to a magnetic carrier in powder or particle form used in electrophotographic development equipment, and, more particularly, to an environmentally benign manganese oxide, iron oxide carrier having titanium dioxide or titanium oxide added thereto to control magnetic brush properties of the carrier.

Carriers in the form of powder or particles are used to transfer toner in many types of electrophotographic development equipment or reprographic equipment. For example, such powders are used in copying machines and laser printers. Typically such carriers are ferrite powders that consist of iron oxide in combination with various metal oxides such as nickel, zinc or copper among others. Patents have been issued directed to various ferrite carrier compositions including the following: U.S. Pat. Nos. 4,623,603, Timura et al.; 4,85,162, Honjo et al.; 4,898,801, Tachibana et al.; 4,485,162, Imamura et al.; and 3,929,657, Jones. Such prior art patents teach both single component and dual component ferrite carriers. These patents also teach various crystalline structures for the carriers. These patents also teach the utilization of compositions of ferrites with various metals and various processes for the manufacture of such carriers.

The need to provide environmentally benign carriers which may be safely and easily recycled or disposed following use is a growing prerequisite design consideration for electrophotographic development equipment. Currently many compositions which are used as carriers, contain elements that might be regarded as hazardous to the environment. The proposed invention concerns a composition which does not present the environmental concerns of many currently available carriers.

It is also known that when an iron oxide carrier is selected for electrophotographic magnetic brush development, the electrical conductivity and the magnetic properties of the carrier are important and parameters are often established for desired development characteristics. Additionally, carriers are often coated with various polymer resins selected for compatibility with specific toners. Polymer coatings are known to typically reduce the conductivity or increase the resistivity of the carriers. Conductive additives such as carbon black may also be added to coatings to increase the conductivity or lower the resistivity of carriers. However, coatings on carrier surfaces wear or erode and subsequently are transferred onto the copied or printed documents along with the toner. Black toner applications typically do not show adverse effects resulting from the transfer of additives. However, the image quality from color toner applications, which are becoming more and more popular, can be adversely affected. The color toner applications for magenta, cyan and yellow thus may be adversely affected in many circumstances and so there has developed a need to provide an environmentally benign iron oxide or ferrite carrier particle or core which maintains an appropriately high conductivity prior to coating and which can simultaneously offer a range of magnetic values useful in magnetic brush developer systems particularly for color reprographics.

SUMMARY OF THE INVENTION

Briefly, the present invention comprises an improved magnetic carrier which is made from a combination of an iron oxide, e.g. ferrite ($Fe_2O_3$) and an oxide of manganese, e.g. manganese oxide or manganese dioxide with an additive of titanium dioxide in the range typically of 0.5 to 10% by weight. It has been found that such carriers are useful because of their high conductivity or low resistivity and further because their magnetic moment may be limited to less than 80 electromagnetic units per gram (emu/g). The maintenance of a magnetic moment below about 80 emu/g is especially important in color electrophotographic machines. While high moment carriers are useful for some applications (those greater than 80 emu/g), the presently available equipment for color applications preferably utilizes carriers having a lower magnetic moment, typically in the range below 80 and more desirably in the range of 60–65 emu/g. Failure to provide a lower magnetic moment carrier as described may tend to cause the formation of rigid magnetic toning brushes which can scratch the surface of a photo conductor roll thereby leading to premature failure or limited copy detail, particularly with color electrophotographic machines. Such a deficiency results from the inability of a stiff brush to effectively present toner particles to the photo conductor during the toner transfer phase of the developing process. The present invention permits widely varying magnetic moments by an environmentally benign ferrite carrier powder or particle while maintaining high electrical conductivity, typically less than $1\times10^8$ ohm-cm.

Thus it is an object of the invention to provide an improved electrophotographic development, carrier material which is environmentally safe and benign.

It is a further object of the invention to provide an electrophotographic carrier that is useful to the same degree as prior art carriers, particularly carriers comprising ferrites in combination with metal elements.

Another object of the invention is to provide an electrophotographic carrier core which maintains high electrical conductivity or low resistivity while simultaneously maintaining the capability of providing a wide range of magnetic properties as compared to prior art carriers.

A further object of the invention is to provide an electrophotographic development carrier comprised of an oxide of manganese, an iron oxide and titanium oxide or titanium dioxide.

Another object of the invention is to provide an electrophotographic carrier material which may be manufactured in the form of a particle and has the capability of being coated with a polymer resin which does not contain any conductive additives thus providing a powder that displays electrical resistivity or conductivity similar to or the same as prior art carriers that may have required such additives.

Another object of the invention is to provide a manganese ferrite powder for use as a carrier material in electrophotographic machines which can be used in machines already in service as well as new machines.

These and other objects, advantages and features of the invention are set forth in additional detail in the description which follows.

BRIEF DESCRIPTION OF THE DRAWING

In the detailed description which follows, reference will be made to the single FIGURE setting forth the process flow steps in the manufacture of the material or composition of the invention.

DESCRIPTION OF THE PREFERRED EMBODIMENTS

Heretofore, applicant disclosed and claimed an environmentally benign electrophotographic carrier which includes lithium oxide in combination with ferric materials, (See U.S. Pat. No. 5,798,198). Such an environmentally friendly carrier composition, though quite useful, is highly resistive or has low conductivity. Consequently, such material was found to be often unacceptable particularly with color copying equipment. As a result, manufacturers began to use magnetites for some reprographic applications because of their high conductivity. Magnetites are considered to be environmentally acceptable and have high conductivity which is necessary. Magnetites, however, have the disadvantage that they may result in scratching photo conductor rolls or otherwise damaging the reprographic equipment. Additionally, magnetites may oxidize or change chemically particularly in certain environmental situations.

The present invention comprises a combination of an oxide of manganese and iron oxide along with titanium dioxide. The oxides are mixed. The manganese as a starting material may be in the form of manganese oxide or manganese dioxide or any other oxide or other compound which forms manganese oxide when calcined or heat treated. The preferred process for making the carrier includes mixing of the starting oxides or constituents and subsequent calcining, sintering and processing.

Titanium oxide or titanium dioxide is added before or after the calcining operation. The calcined material is then milled. Again, titanium oxide or titanium dioxide may be added before or after the milling and in any event the titanium dioxide, manganese oxide and ferrite must be subjected to some type of heat treatment. This results because the titanium dioxide (or titanium oxide) substitutes for the ferric ion in the crystalline lattice. This causes the material to become ferrous in nature rather than ferric so that the mixture or combination, as recited, is not as highly magnetic. However, the conductivity is not adversely impacted.

It is noted that the final carrier is typically a single phase material. The titanium oxide replaces the iron in the lattice and is not located at or within the grain boundaries. The crystalline structure is typically a spinel structure.

In determining the amounts of each of the constituents to be added to the mix, it is noted that the composition is non-stoichiometric. For this reason, it is typically necessary to control the oxygen availability during the final sintering operations to establish stoichiometry in the system. In this regard, the oxygen amounts are limited during sintering typically to less than 2%, preferably less than 0.2%.

A series of examples have been prepared comparing manganese ferrite carrier core materials with the composition of the invention; namely, with the manganese, ferrite/titanium dioxide combination. It is noted that all of the resulting data set forth in the table was obtained by sintering the resulting compositions in an atmosphere where the oxygen content was less than 0.2% and the resulting powder was classified as approximately a 50 micron average size. Table 1 sets forth the comparative data for the compositions tested.

TABLE 1

Comparison of manganese ferrite carrier core properties

| Ferrite Composition Mole Fraction | $(MnO)_{0.1}(Fe_2O_3)_{0.9}$ | $(MnO)_{0.2}(Fe_2O_3)_{0.8}$ | $(MnO)_{0.4}(Fe_2O_3)_{0.6}$ | $(MnO)_{0.5}(Fe_2O_3)_{0.5}$ |
|---|---|---|---|---|
| $TiO_2$ Added by Weight % | None | None | None | None |
| Magnetic Saturation emu/g) | 95 | 94 | 90 | 80 |
| Resistivity @ 100 V (ohm-cm) | $6 \times 10^7$ | $6 \times 10^7$ | $2 \times 10^8$ | $6 \times 10^8$ |
| Ferrite Composition Mole Fraction | $(MnO)_{0.4}(Fe_2O_3)_{0.6}$ | $(MnO)_{0.4}(Fe_2O_3)_{0.6}$ | $(MnO)_{0.4}(Fe_2O_3)_{0.6}$ | $(MnO)_{0.4}(Fe_2O_3)_{0.6}$ |
| $TiO_2$ Added by Weight % | 4 | 4.5 | 5 | 6.5 |
| Magnetic Saturation emu/g) | 79 | 70 | 66 | 58 |
| Resistivity @ 100 V (ohm-cm) | $5 \times 10^7$ | $4 \times 10^7$ | $3 \times 10^7$ | $9 \times 10^7$ |

Note:
The results were obtained by sintering the resulting compositions in an atmosphere where the oxygen content was less than 0.2% and the resulting powder was classified to approximately 50 micron average size.

The first set of data in Table 1 relates to compositions of manganese oxide and ferric oxide without any substitute molecules or elements. The second set of data includes the addition of titanium dioxide to the composition in weight percent. It will be noted that the resistivity or conductivity of each of the systems in the table is generally considered to be acceptable as required in a photocopy machine. However, the magnetic saturation in electromagnetic units per gram for the compositions which include titanium dioxide are generally below 80 and typically in the range of 55 to 80. This magnetic saturization or magnetic moment is thus lower than the magnetic moment or saturation of compositions of manganese ferrite carrier alone. Thus the ferrite composition, which includes the titanium dioxide, is useful particularly with color copiers.

A preferred range of constituents and example of the composition and its physical parameters is as follows:

MnO content in mole fraction: 0.35–0.45.

$Fe_2O_3$ content in mole fraction: 0.55–0.65.

$TiO_2$ additive in weight percent: 4.5–5.5%.

Oxygen content less than 2% during sintering.

Magnetic moment 60–70 emu/g.

Resistivity: $4–6 \times 10^7$ ohm-cm @ 100 V.

Average particle size: 50 microns.

Following is a specific example of the process which is practiced in order to manufacture the aforesaid described ferrite compositions set forth in Table 1. Referring to the FIGURE, the following steps are undertaken:

First, the respective oxides in the appropriate amounts are batched mixed uniformly in a batch mixing operation, for example, using a state of the art batch mixer. Thus, ferric oxide ($(Fe_2O_3)$ manganese oxide (MnO) and titanium dioxide are mixed together in amounts such as set forth in Table 1. It is to be noted that the titanium dioxide may be added during this first batch mixing step or in a subsequent step as described below.

Second, the optional step of calcining the mixed oxides is performed. Typically, the mixed oxides are exposed to a heating or calcining operation in the range of 700° to 1,200° C. for a period of 30 minutes to 2 hours. The resultant material is a mixture of particles in the spinel structure or phase comprised of the manganese oxide and ferric oxide materials.

Third, the particles or oxide mix, as the case may be, is subjected to a wet milling operation. In this manner, the particle size of the ferrite is reduced prior to formation in the spherical configuration.

Fourth, the wet milled slurry is subjected to a spray drying operation which forms spherically shaped, dry beads.

Fifth, the particles are classified according to size.

Sixth, the beads or powder is sintered in a kiln wherein the atmosphere is controlled and more particularly the oxygen content is controlled. Typically the oxygen content is kept at less than 2% so that the stoichiometry of the ferrite materials or oxides is maintained. As mentioned above, the titanium dioxide replaces the iron at various sites in the crystalline phase. This renders the mixture as having more of a ferrous characteristic thereby reducing the magnetic moment of the material while maintaining conductivity.

Seventh, the sintered material is deagglomerated so that there is a complete dispersion of the particles.

Eighth, the particles are classified once again with the objective of providing substantially uniform size particles, preferably in the range of 50 microns ±2 microns on the average. Undersized and oversized particles are recycled.

The titanium oxide set forth in the examples is a preferred substitute material and the range of such material is also a preferred range.

Thus while there has been set forth preferred embodiments of the invention, it is to be understood that the invention is limited only by the following claims and equivalents.

What is claimed is:

1. A carrier core having a composition consisting essentially of 10 to 50 mole percent of manganese oxide;

about 90 to 50 mole percent of ferric oxide; and a titanium dioxide compound comprising 0.5 to 10 percent by weight of the composition, said constituents sintered together and forming a spinel phase, stoichiometric material having a resistivity in the range of about $3\times10^7$ to $1\times10^8$ ohm cm at 100 volts.

2. A carrier core as set forth in claim 1 with a polymer coating.

3. The carrier core having the composition of claim 1 wherein the magnetic moment of the composition is less than about 80 emu per gram.

4. The carrier core having the composition of claim 1 wherein the magnetic moment of the composition is in the range of about 40 to 80 emu per gram.

5. The carrier core having the composition of claim 1 in the form of a powder having an average size of about 50 microns.

6. In combination, a core as set forth in claim 1 in the form of particles and a toner.

7. The carrier core of claim 1 which is sintered in an atmosphere of less than about 2% oxygen to maintain ferrite stoichiometry.

8. The carrier core of claim 1 which is sintered in an atmosphere of less than about 0.2% oxygen to maintain ferrite stoichiometry.

9. A carrier core particulate, consisting essentially of: a powder having an average particle size of about 50 microns, said powder consisting essentially of 0.35–0.45 mole fraction MnO, 0.55–0.65 mole fraction $Fe_2O_3$, and 4.5–5.5% by additive weight $TiO_2$, and having a magnetic moment in the range of 60 to 70 emu/g, resistivity of $4–6\times10^7$ ohm cm at 100 V and a stoichiometric, spinel crystalline structure.

* * * * *

UNITED STATES PATENT AND TRADEMARK OFFICE

CERTIFICATE OF CORRECTION

PATENT NO. : 6,294,304 B1
DATED : September 25, 2001
INVENTOR(S) : Alan Sukovich et al.

It is certified that error appears in the above-identified patent and that said Letters Patent is hereby corrected as shown below:

Drawings,
Substitute the attached Figure for the Figure in the patent.

Signed and Sealed this

Twenty-fifth Day of March, 2003

JAMES E. ROGAN
*Director of the United States Patent and Trademark Office*

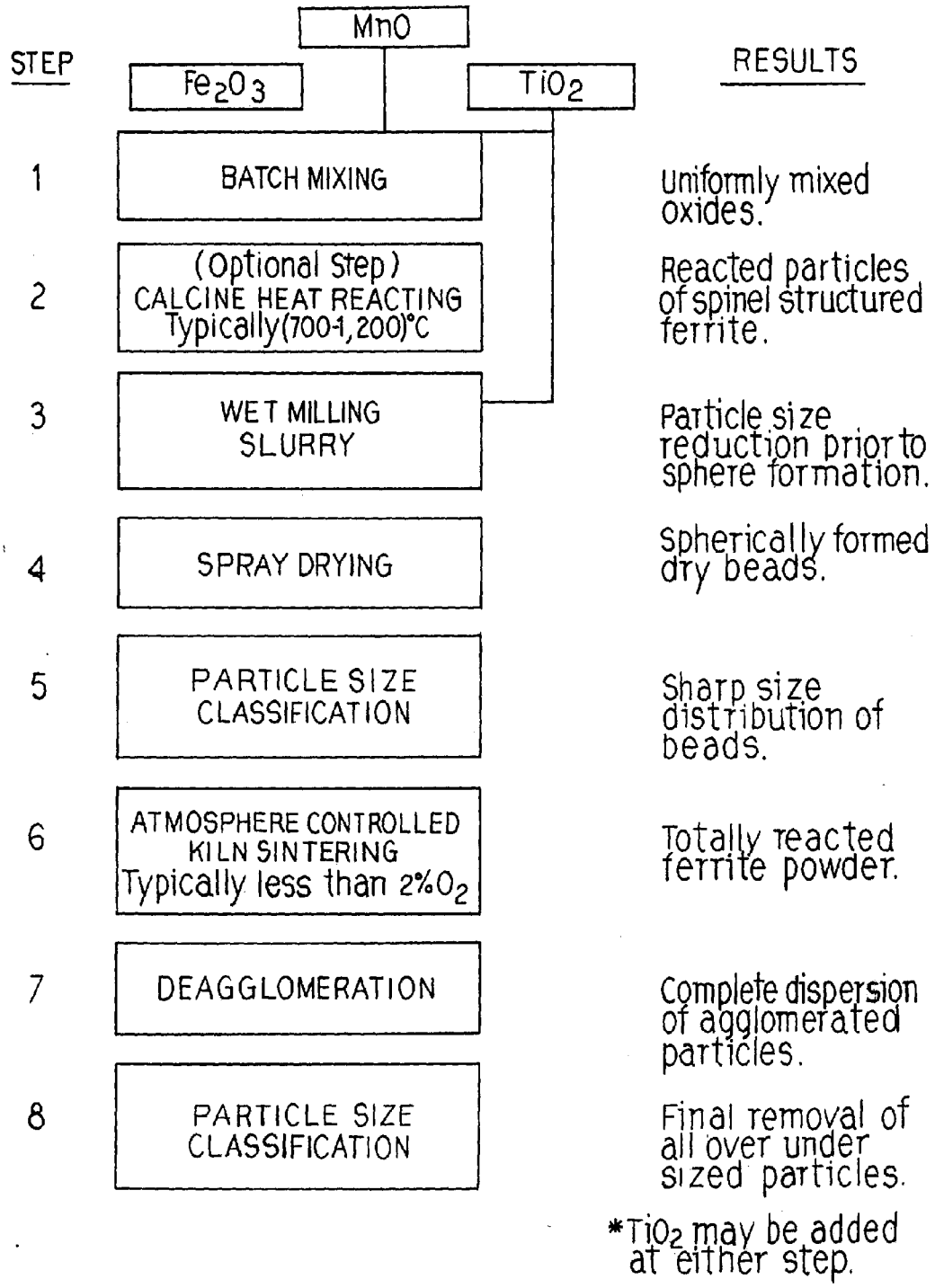

PROCESS FLOW OF INVENTION